US008368459B2

(12) United States Patent
Kamitani et al.

(10) Patent No.: US 8,368,459 B2
(45) Date of Patent: Feb. 5, 2013

(54) CONSTANT-VOLTAGE CIRCUIT

(75) Inventors: Masatoshi Kamitani, Osaka (JP); Masato Seki, Osaka (JP); Hiroshi Komori, Shiga (JP); Masahiro Maeda, Osaka (JP)

(73) Assignee: Panasonic Corporation, Osaka (JP)

( * ) Notice: Subject to any disclaimer, the term of this patent is extended or adjusted under 35 U.S.C. 154(b) by 167 days.

(21) Appl. No.: 13/070,106

(22) Filed: Mar. 23, 2011

(65) Prior Publication Data

US 2011/0304386 A1 Dec. 15, 2011

(30) Foreign Application Priority Data

Jun. 10, 2010 (JP) ..... 2010-132524

(51) Int. Cl.
*G05F 1/10* (2006.01)

(52) U.S. Cl. ..... 327/540; 327/538

(58) Field of Classification Search ..... 323/315, 323/316; 327/538, 540, 541, 543
See application file for complete search history.

(56) References Cited

U.S. PATENT DOCUMENTS

| | | | | |
|---|---|---|---|---|
| 5,420,532 | A | 5/1995 | Teggatz et al. | |
| 6,259,324 | B1 | 7/2001 | Antognetti et al. | |
| 6,285,245 | B1 | 9/2001 | Watanabe | |
| 7,656,224 | B2 * | 2/2010 | Perez et al. | 327/540 |
| 7,663,356 | B2 | 2/2010 | Inatomi | |
| 7,893,728 | B2 * | 2/2011 | Hirai | 327/103 |
| 2007/0159145 | A1 | 7/2007 | Liwinski | |

FOREIGN PATENT DOCUMENTS

JP 2006-352241 12/2006

* cited by examiner

*Primary Examiner* — Jeffrey Zweizig
(74) *Attorney, Agent, or Firm* — Hamre, Schumann, Mueller & Larson, P.C.

(57) ABSTRACT

A constant-voltage circuit includes: first and second field-effect transistors; a first node connected to the drains of the first and second field-effect transistors; a second node connected to the gates of the first and second field-effect transistors; a bipolar transistor whose collector is connected to the second node; a resistor connected to the source of the second field-effect transistor and the collector of the bipolar transistor; and a bias circuit that is connected to the source of the second field-effect transistor and supplies a bias voltage to the base of the bipolar transistor, wherein a power supply is connected to the first node and a constant voltage is outputted from the source of the first field-effect transistor.

11 Claims, 6 Drawing Sheets

CONSTANT-VOLTAGE CIRCUIT

BACKGROUND OF THE INVENTION (1) Field of the Invention

The present invention relates to a constant-voltage circuit for a reference voltage.

(2) Description of the Related Art

In recent years, radio communications with higher transmission rates and higher speeds have been requested in mobile communication systems of, e.g., cellular phones. As digital modulation signals for achieving higher transmission rates and higher speeds, a digital modulation signal of high speed downlink packet access (HSDPA) system and a digital modulation signal of high speed uplink packet access (HSUPA) system have been proposed. In these digital modulation signals, the amplitude of the peak voltage tends to increase. Therefore, in a mobile communication system using these digital modulation signals, low distortion and high efficiency characteristics are necessary and thus a linear RF power amplifier is used as an amplifier for transmission. In such a linear RF power amplifier, an idle current has to be stabilized to keep linearity and the stabilization of an idle current requires a constant-voltage circuit. In recent years, constant-voltage circuits for stabilizing idle currents have been configured on the same integrated circuit (IC) as GaAs linear amplifiers.

FIG. 6 shows a constant-voltage circuit of the related art described in U.S. Patent Publication No. 2007/0159145. As shown in FIG. 6, the constant-voltage circuit of the related art includes a bipolar transistor Q1, a field-effect transistor Q2, two resistors R1 and R2, and a diode D1. A stable constant voltage Vreg is supplied from the source of the field-effect transistor Q2.

In the constant-voltage circuit of FIG. 6, the constant voltage Vreg is expressed by equation (1):

[Expression 1]

$$V_{reg} = I_1 \times R_2 + V_{be} + V_F = \frac{R_2}{R_1} \times V_{th} + V_{be} + V_F \quad (1)$$

where I1 is a current passing through the resistor R2, Vbe is the base to emitter voltage of the bipolar transistor Q1, VF is the leading edge voltage (forward voltage) of the diode D1, and Vth is the threshold voltage of the field-effect transistor Q2.

As has been discussed, in the constant-voltage circuit of the related art, the constant voltage Vreg is supplied from the source of the field-effect transistor Q2. In the constant-voltage circuit of the related art, however, the constant voltage Vreg considerably depends on the threshold voltage Vth of the field-effect transistor Q2 as is evident from equation (1). Typically, the threshold voltage Vth of the field-effect transistor is largely deviated during manufacture (manufacturing variations) and thus in the constant-voltage circuit of the related art, there are large manufacturing variations in the constant voltage Vreg due to deviations of the threshold voltage Vth of the field-effect transistor during manufacture.

SUMMARY OF THE INVENTION

An object of the present invention is to provide a constant-voltage circuit which can supply a constant voltage while suppressing dependence on the threshold voltage of a field-effect transistor.

In order to attain the object, a constant-voltage circuit according to the present invention includes: first and second field-effect transistors; a first node connected to the drains of the first and second field-effect transistors; a second node connected to the gates of the first and second field-effect transistors; a bipolar transistor whose collector is connected to the second node; a resistor connected to the source of the second field-effect transistor and the collector of the bipolar transistor; and a bias circuit that is connected to the source of the second field-effect transistor and supplies a bias voltage to the base of the bipolar transistor, wherein a power supply is connected to the first node and a constant voltage is outputted from the source of the first field-effect transistor.

Further, the first and second field-effect transistors may each have a gate width and a gate length so as to operate with equal current densities. The first and second field-effect transistors may be depletion-type FETs. The bipolar transistor may be a heterojunction bipolar transistor. The first and second field-effect transistors may be pseudomorphic high electron mobility transistors. The bias circuit may include multiple resistors. The bias circuit may include multiple bipolar transistors.

Further, the constant-voltage circuit according to the present invention may include a switch element connected to the first node and the power supply. The switch element may be a third field-effect transistor. The third field-effect transistor may be a depletion-type FET. The third field-effect transistor may be a pseudomorphic high electron mobility transistor.

According to the present invention, it is possible to supply a constant voltage while suppressing the dependence on the threshold voltage of the field-effect transistor, thereby suppressing manufacturing variations in the constant voltage supplied from the source of the field-effect transistor.

The constant-voltage circuit of the present invention can supply a constant voltage Vreg while suppressing dependence on a threshold voltage Vth of a field-effect transistor, and thus is useful for a device requiring a stable reference voltage.

DESCRIPTION OF THE PREFERRED EMBODIMENTS

The following will describe embodiments of a constant-voltage circuit according to the present invention with reference to the accompanying drawings.

(First Embodiment)

Figure 1:
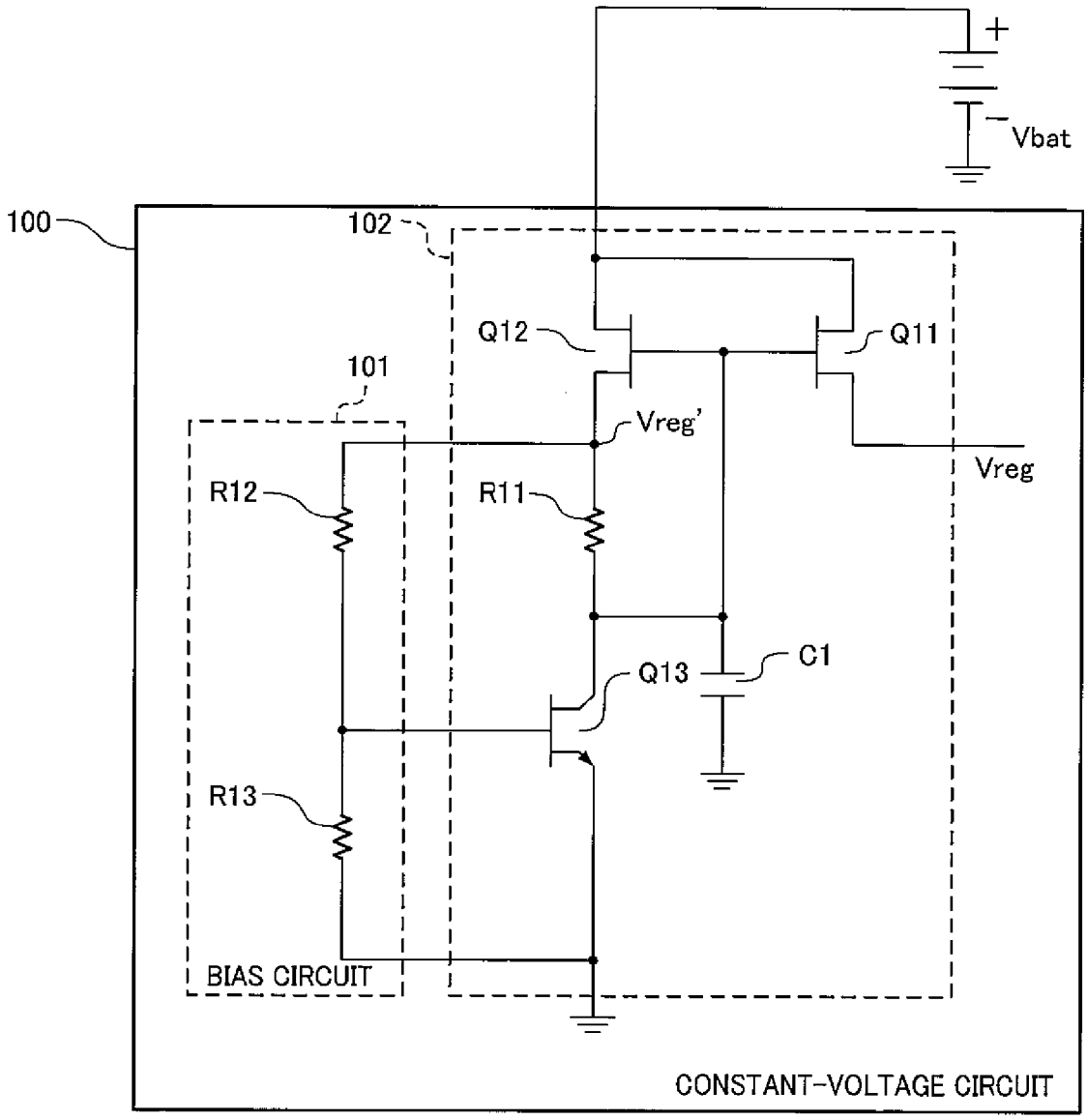
FIG. 1 shows a structural example of a constant-voltage circuit according to a first embodiment of the present invention.

FIG. 1 shows a structural example of a constant-voltage circuit according to a first embodiment of the present invention. As shown in FIG. 1, a constant-voltage circuit 100 is roughly divided into a bias circuit 101 and a current mirror unit 102.

In the current mirror unit 102, the drains of a field-effect transistor Q11 and a field-effect transistor Q12 are connected in common at a first node and the gates of the transistors are connected in common at a second node. In the first embodiment, the field-effect transistors QI1 and Q12 are depletion-type FETs. Thus the field-effect transistors Q11 and Q12 have threshold voltages of 0 V or less. Needless to say, the first and second field-effect transistors are not limited to a depletion type in the present invention.

In the constant-voltage circuit 100, a voltage source (power supply) Vbat is connected to the first node at which the drains of the field-effect transistors Q11 and Q12 are connected in common, and a constant voltage Vreg is supplied from the source of the field-effect transistor Q11. In other words, the constant voltage Vreg is the source voltage of the field-effect transistor Q11.

The second node is connected to one end of a resistor R11, and the other end of the resistor R11 is connected to the source of the field-effect transistor Q12. Further, the second node is connected to the collector of a bipolar transistor Q13. The emitter of the bipolar transistor Q13 is connected to a ground potential.

The following will discuss the bias circuit 101. The bias circuit 101 is connected to the source of the field-effect transistor Q12 and generates a bias voltage to be supplied to the base of the bipolar transistor Q13, based on a source voltage Vreg' of the field-effect transistor Q12. In the first embodiment, the bias circuit 101 is a voltage divider circuit composed of two resistors R12 and R13.

In the constant-voltage circuit 100, the second node is also connected to one electrode of a capacitor C1 and the other electrode of the capacitor C1 is connected to the ground potential. The capacitor C1 can stabilize the gate voltages of the field-effect transistors Q11 and Q12. The provision of the capacitor C1 is optional.

In this configuration, the source voltage Vreg' of the field-effect transistor Q12 is expressed by equation (2):

[Expression 2]

$$V'_{reg} = \left(1 + \frac{R_{12}}{R_{13}}\right)V_{be} = \left(1 + \frac{R_{12}}{R_{13}}\right)\frac{KT}{q}\ln\left(\frac{V_{th}}{IsR_{11}}\right) \quad (2)$$

K: Boltzmann constant

T: absolute temperature q: amount of electronic charge

Is: reverse saturation current of bipolar transistor where Vth is the threshold voltage of the field-effect transistors Q11 and Q12, and Vbe is the base to emitter voltage of the bipolar transistor Q13.

Equation (2) is partially differentiated by Vth into equation (3):

[Expression 3]

$$\frac{\partial V'_{reg}}{\partial V_{th}} = \left(1 + \frac{R_{12}}{R_{13}}\right)\frac{KT}{qV_{th}} \quad (3)$$

Equation (3) represents the dependence of the source voltage Vreg' on the threshold voltage Vth of the field-effect transistor. The threshold voltage Vth has a coefficient KT/q of 0.026 V at an ambient temperature of 27° C.

In the constant-voltage circuit 100, as is evident from equation (3), the source voltage Vreg' of the field-effect transistor Q12 is less dependent on the threshold voltage Vth of the field-effect transistors Q11 and Q12. In other words, when the threshold voltage Vth of the field-effect transistors Q11 and Q12 fluctuates, the gate voltage of the field-effect transistors Q11 and Q12 also fluctuates, suppressing a change of the source voltage Vreg' of the field-effect transistor Q12. The resistance value of the resistor R11 is determined by the amount of current applied to the bipolar transistor Q13.

Further, in the constant-voltage circuit 100, the field-effect transistor Q11 and the field-effect transistor Q12 constitute a current mirror circuit and have a gate width and a gate length so as to operate with equal current densities, so that the voltage Vreg' is equal to the voltage Vreg. Thus equation (3) also represents the dependence of the constant voltage Vreg on the threshold voltage Vth of the field-effect transistor. In other words, in the constant-voltage circuit 100, the dependence of the constant voltage Vreg on the threshold voltage Vth of the field-effect transistors Q11 and Q12 is suppressed as in the case of the source voltage Vreg' of the field-effect transistor Q12.

Figure 6:
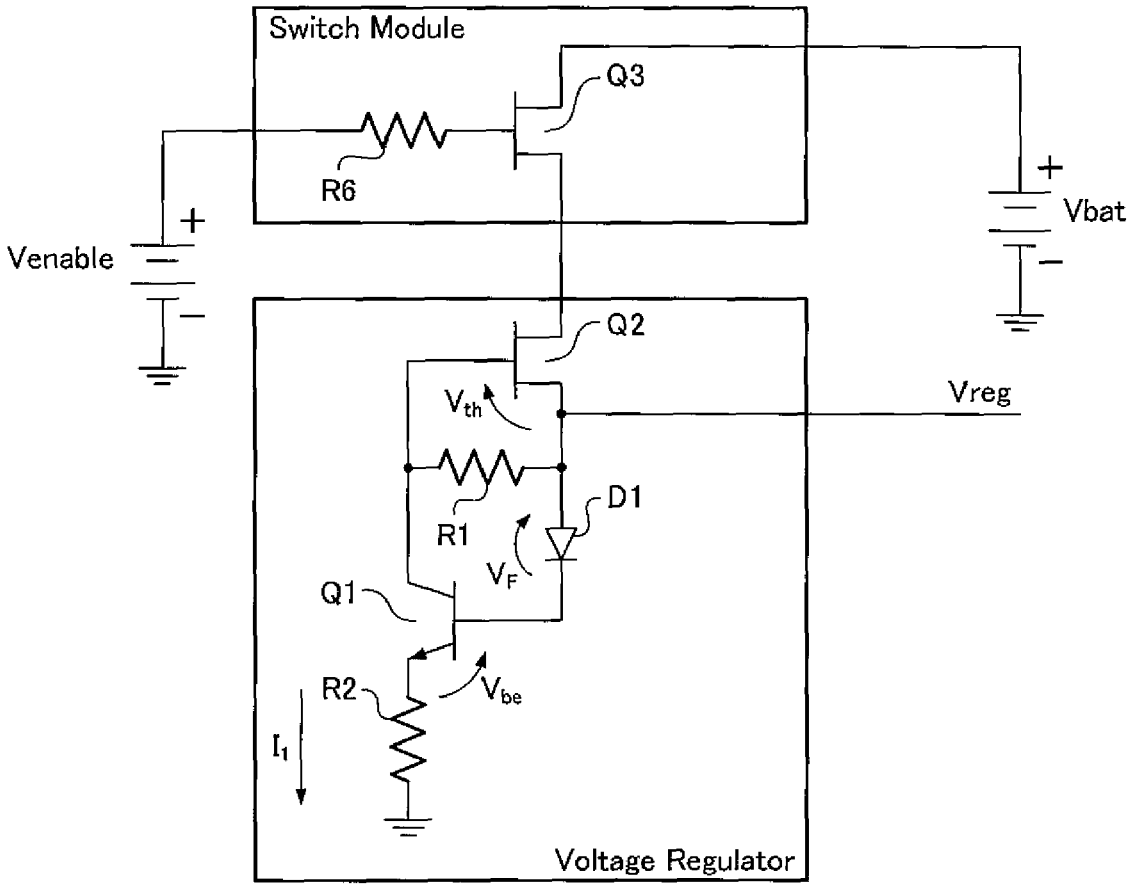
FIG. 6 PRIOR ART
FIG. 6 shows the configuration of a constant-voltage circuit according to the related art.

For example, when the constant voltage Vreg is set at 3 V, R12/R13 is set at 1.5. Thus in equation (3), the coefficient of Vth is 2.5 KT/q. Since KT/q is 0.026 V at an ambient temperature of 27° C., the coefficient of Vth is 0.06578 V. Therefore, as compared with the constant-voltage circuit of the related art in FIG. 6, the dependence of the constant voltage Vreg on the threshold voltage is reduced to about one twentieth.

Figure 2:
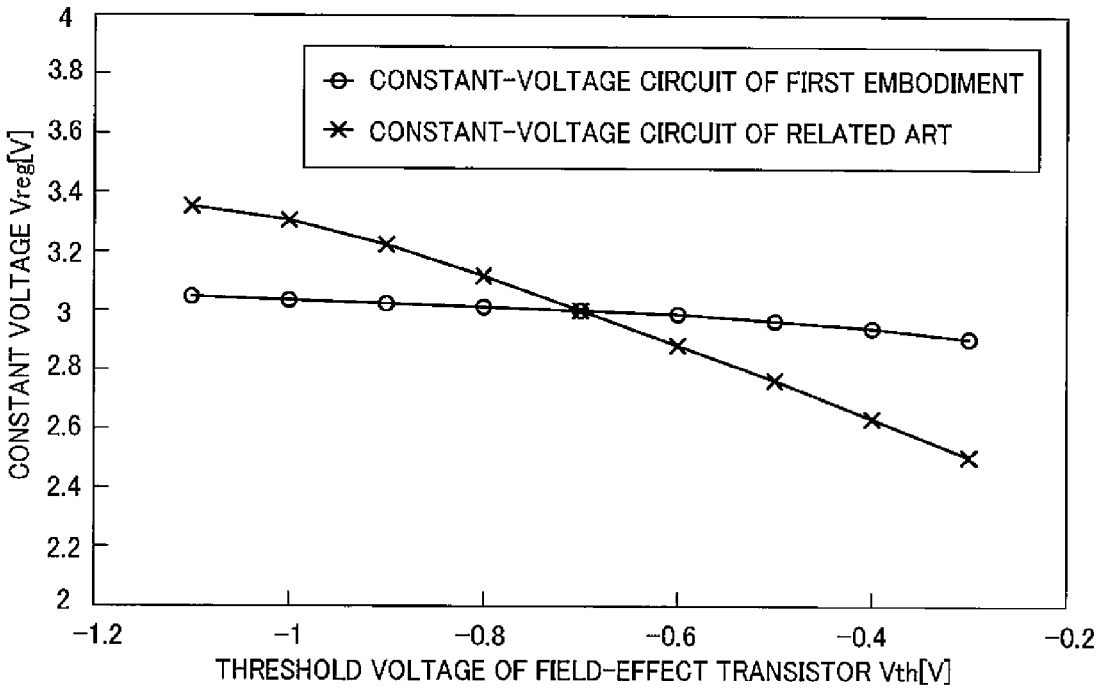
FIG. 2 shows simulation results on the relationship between a threshold voltage of field-effect transistors and a constant voltage in the constant-voltage circuit according to the first embodiment of the present invention.

FIG. 2 shows simulation results on the relationship between the threshold voltage Vth of the field-effect transistors and the constant voltage Vreg. In this simulation, in order to set the constant voltage Vreg at 3 V, the resistance values of the resistors R11, R12, and R13 were set at 7000Ω, 7100Ω, and 4800Ω, respectively. As shown in FIG. 2, the dependence of the constant voltage Vreg on the threshold voltage Vth of the field-effect transistors Q11 and Q12 is suppressed in the constant-voltage circuit 100.

As has been discussed, the constant-voltage circuit 100 of the first embodiment can supply the constant voltage Vreg while suppressing the dependence on the threshold voltage Vth of the field-effect transistors, thereby suppressing manufacturing variations in the constant voltage supplied from the source of the field-effect transistor.

In the case where the constant-voltage circuit 100 is configured on the same integrated circuit (IC) as a GaAs linear amplifier, the bipolar transistor Q13 is preferably a heterojunction bipolar transistor (HET) and the field-effect transistors Q11 and Q12 are preferably pseudomorphic high electron mobility transistors (PHEMTs).

(Second Embodiment)

Figure 3:
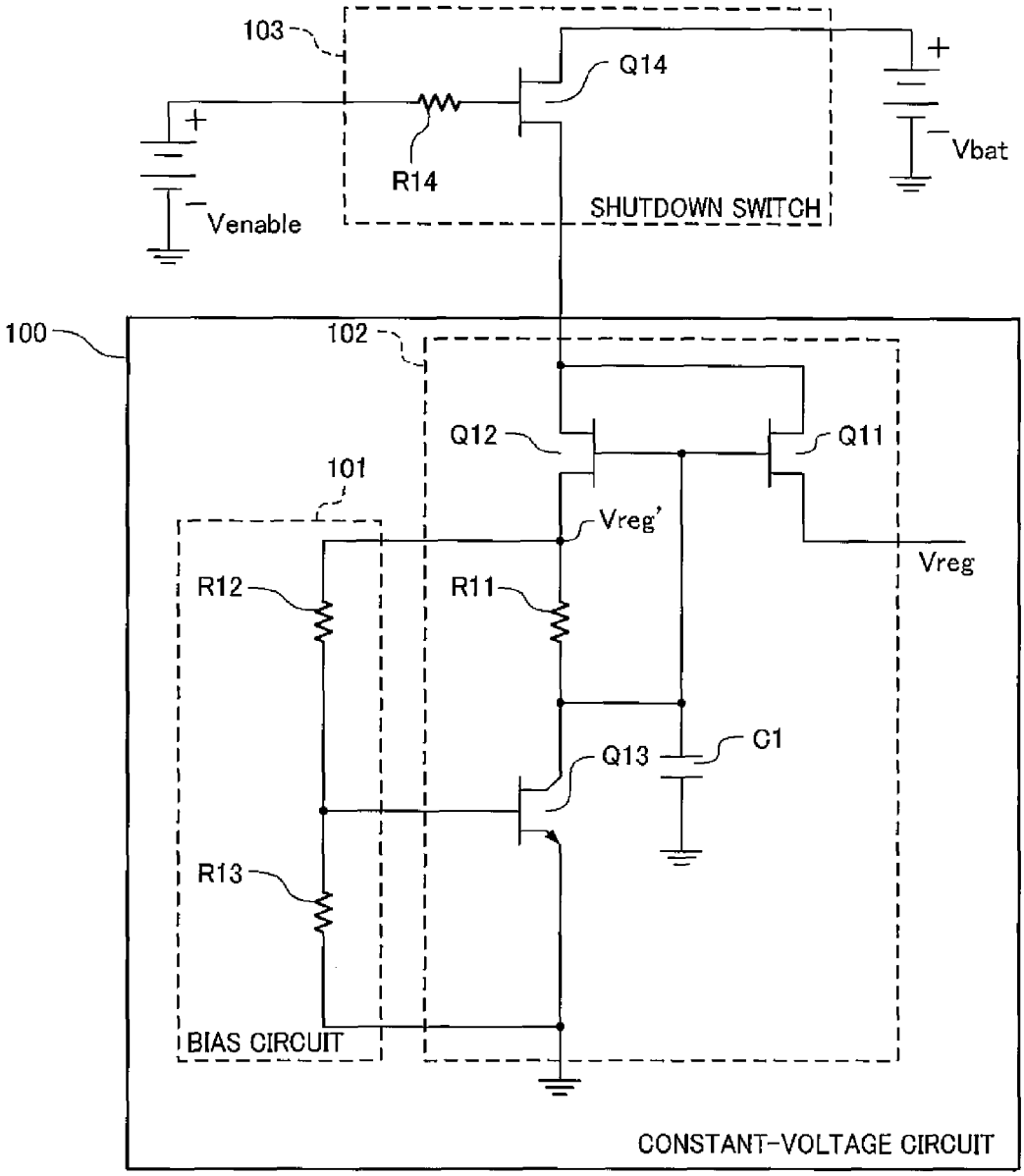
FIG. 3 shows a structural example of a constant-voltage circuit according to a second embodiment of the present invention.

Referring to FIG. 3, the following will describe a second embodiment of a constant-voltage circuit according to the present invention. FIG. 3 shows a structural example of the constant-voltage circuit according to the second embodiment of the present invention. The same constituent elements as in the first embodiment will be indicated by the same reference numerals and the explanation thereof is omitted.

The constant-voltage circuit of the second embodiment is different from the constant-voltage circuit of the first embodiment in that a shutdown switch 103 is connected between a first node, to which the drains of field-effect transistors Q11 and Q12 are connected in common, and a voltage source Vbat.

The shutdown switch 103 includes a field-effect transistor Q14 as a switch element for interrupting a voltage supplied from the voltage source Vbat. Like the field-effect transistors Q11 and Q12, the field-effect transistor Q14 is a depletion-type FET. Needless to say, the field-effect transistor Q14 is not limited to a depletion type in the present invention.

The drain of the field-effect transistor Q14 is connected to the voltage source Vbat. The source of the field-effect transistor Q14 is connected to the first node. The gate of the field-effect transistor Q14 is connected to a control voltage source Venable via a resistor R14. With this configuration, when a voltage supplied from the control voltage source Venable is lower than the threshold voltage of the field-effect transistor Q14, no current passes through a constant-voltage circuit 100.

In the case where the constant-voltage circuit 100 of the second embodiment is configured on the same integrated circuit (IC) as a GaAs linear amplifier, a bipolar transistor Q13 is preferably an HET and the field-effect transistors Q11, Q12, and Q14 are preferably PHEMTs as in the constant-voltage circuit of the first embodiment.

(Third Embodiment)

Figure 4:
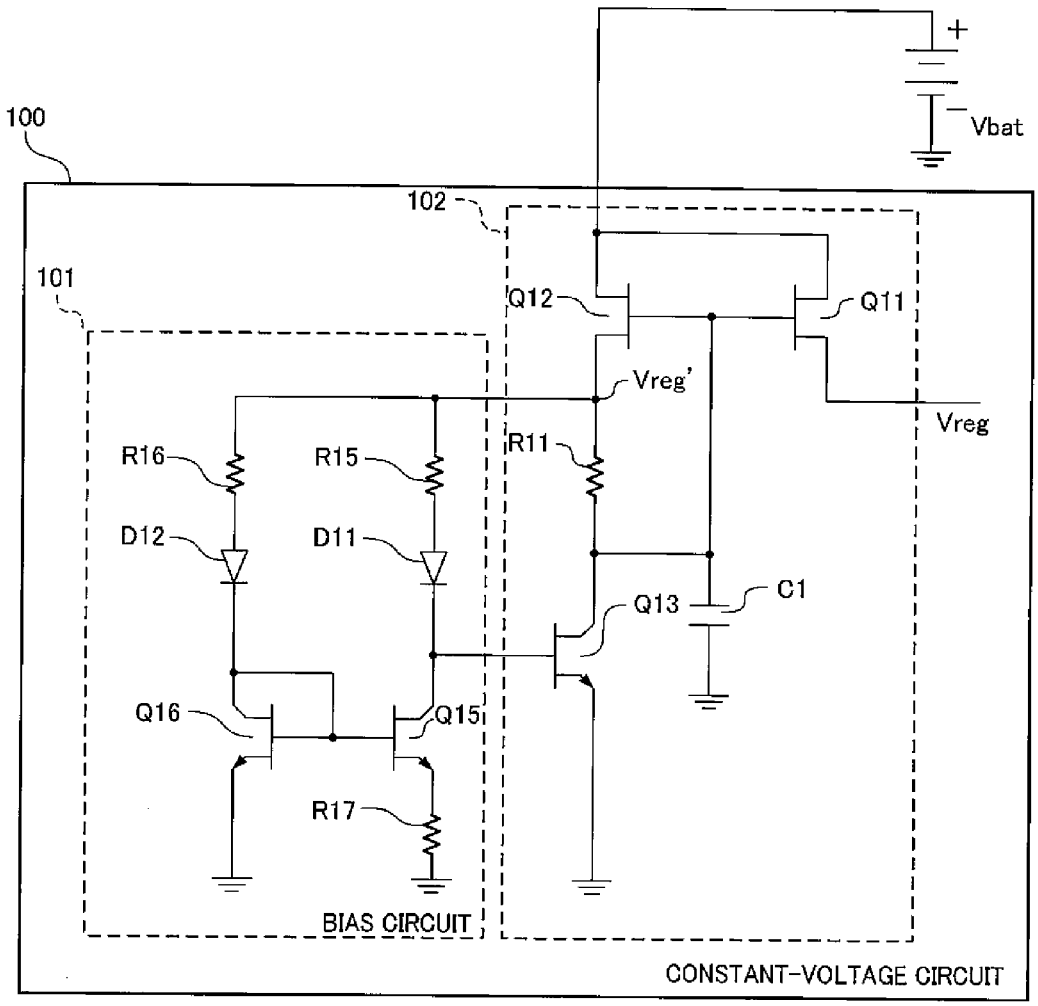
FIG. 4 shows a structural example of a constant-voltage circuit according to a third embodiment of the present invention.

Referring to FIG. 4, the following will describe a third embodiment of a constant-voltage circuit according to the present invention. FIG. 4 shows a structural example of the constant-voltage circuit according to the third embodiment of the present invention. The same constituent elements as in the first embodiment will be indicated by the same reference numerals and the explanation thereof is omitted.

The constant-voltage circuit of the third embodiment is different from the constant-voltage circuit of the first embodiment in that a bandgap bias circuit is provided as a bias circuit for supplying the base voltage of a bipolar transistor Q13.

As shown in FIG. 4, a bias circuit 101 of the third embodiment includes two bipolar transistors Q15 and Q16, two diodes D11 and D12, and three resistors R15 to R17.

Specifically, the collector of the bipolar transistor Q15 is connected to the cathode of the diode D11, and the anode of the diode D11 is connected to the source of a field-effect transistor Q12 via the resistor R15. Similarly, the collector of the bipolar transistor Q16 is connected to the cathode of the diode D12 and the anode of the diode D12 is connected to the source of the field-effect transistor Q12 via the resistor R16. The base of the bipolar transistor Q15 and the base of the bipolar transistor Q16 are connected in common at a third node, and the collector of the bipolar transistor Q16 is connected to the third node. The emitter of the bipolar transistor Q15 is connected to a ground potential via the resistor R17, and the emitter of the bipolar transistor Q16 is directly connected to the ground potential. In this way, the bipolar transistors Q15 and Q16 constitute a current mirror circuit and the base voltage of the bipolar transistor Q13 is supplied from the collector of the bipolar transistor Q15.

When the base voltage of the bipolar transistor Q13 is supplied by the bias circuit 101, the second field-effect transistor Q12 has a source voltage Vreg' expressed by equation (4):

[Expression 4]

$$V'_{reg} = V_{be1} + V_F + \frac{R_{15}}{R_{17}}\Delta V_{be} = \frac{KT}{q}\ln\left(\frac{V_{th}}{IsR_{11}}\right) + V_F + \frac{R_{15}}{R_{17}}\Delta V_{be} \quad (4)$$

$Vbe_1$: emitter to base voltage of bipolar transistor Q13

ΔVbe: difference in emitter to base voltage between bipolar transistor Q15 and bipolar transistor Q16 where Vth is the threshold voltage of a field-effect transistor Q11 and the field-effect transistor Q12, Vbe is the base to emitter voltage of the bipolar transistors Q13, Q15, and Q16, and VF is the leading edge voltage of the diodes D11 and D12.

It is evident that equation (4) is partially differentiated by Vth into the same equation as equation (3). Therefore, like the constant-voltage circuit of the first embodiment, the constant-voltage circuit of the third embodiment can supply a constant voltage Vreg while suppressing dependence on the threshold voltage Vth of the field-effect transistors, thereby suppressing manufacturing variations in the constant voltage supplied from the source of the field-effect transistor.

In the case where a constant-voltage circuit 100 of the third embodiment is configured on the same integrated circuit (IC) as a GaAs linear amplifier, the bipolar transistors Q13, Q15, and Q16 are preferably HBTs and the field-effect transistors Q11 and Q12 are preferably PHEMTs as in the constant-voltage circuit of the first embodiment.

(Fourth Embodiment)

Figure 5:
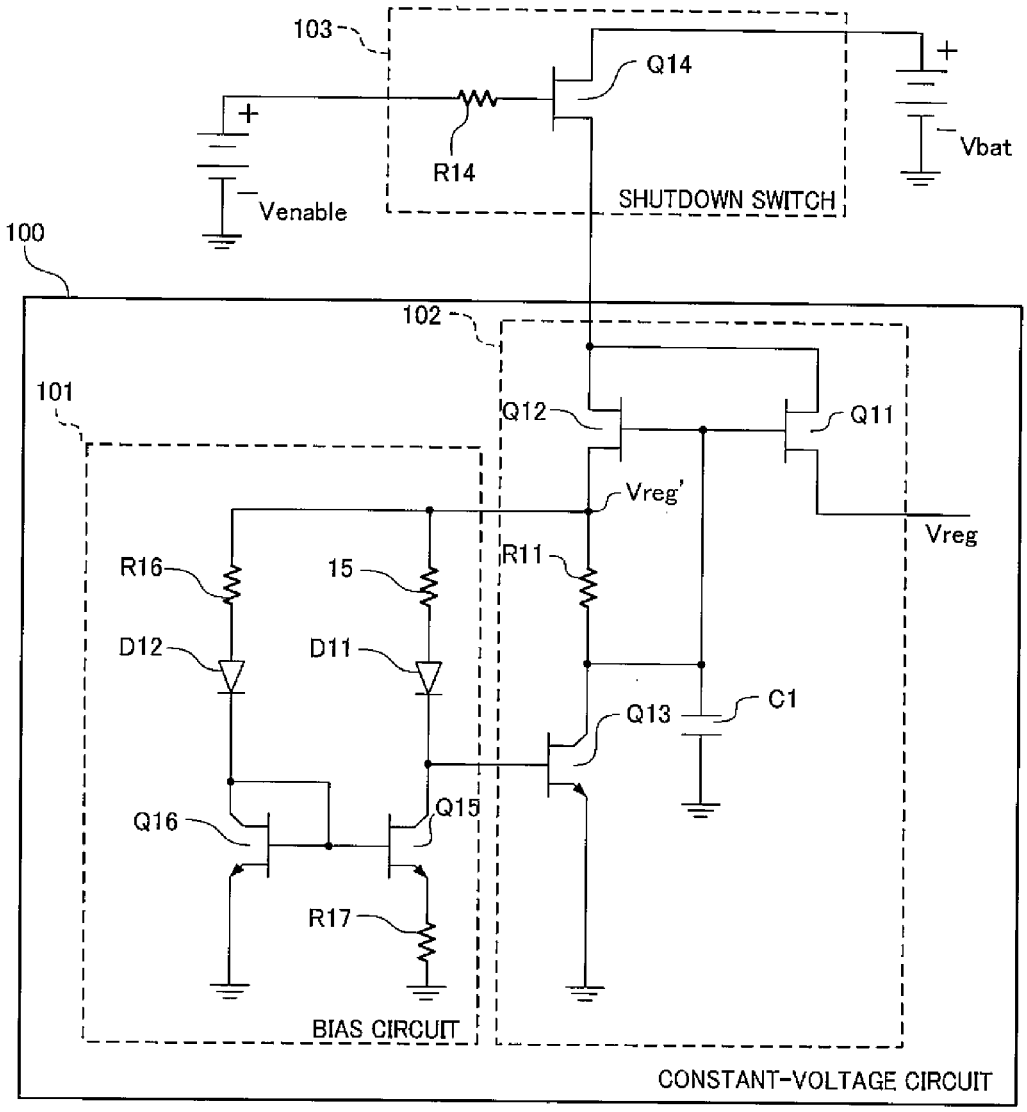
FIG. 5 shows a structural example of a constant-voltage circuit according to a fourth embodiment of the present invention.

Referring to FIG. 5, the following will describe a fourth embodiment of a constant-voltage circuit according to the present invention. FIG. 5 shows a structural example of the constant-voltage circuit according to the fourth embodiment of the present invention. The same constituent elements as in the first to third embodiments will be indicated by the same reference numerals and the explanation thereof is omitted.

The constant-voltage circuit of the fourth embodiment is different from the constant-voltage circuit of the third embodiment in that a shutdown switch 103 is connected between a first node, to which the drains of field-effect transistors Q11 and Q12 are connected in common, and a voltage source Vbat as in the second embodiment. The configuration of the shutdown switch 103 is identical to that of the second embodiment and thus the explanation thereof is omitted.

The shutdown switch 103 is provided thus in the constant-voltage circuit of the third embodiment, so that when a voltage supplied from a control voltage source Venable is lower than the threshold voltage of a field-effect transistor Q14, no current passes through a constant-voltage circuit 100.

In the case where the constant-voltage circuit 100 of the fourth embodiment is configured on the same integrated circuit (IC) as a GaAs linear amplifier, bipolar transistors Q13, Q15, and Q16 are preferably HBTs and the field-effect transistors Q11, Q12, and Q14 are preferably PHEMTs as in the constant-voltage circuit of the first embodiment.

What is claimed is:

1. A constant-voltage circuit comprising:

first and second field-effect transistors;

a first node connected to drains of the first and second field-effect transistors;

a second node connected to gates of the first and second field-effect transistors;

a bipolar transistor whose collector is connected to the second node;

a resistor connected to a source of the second field-effect transistor and the collector of the bipolar transistor; and a bias circuit that is connected to the source of the second field-effect transistor and supplies a bias voltage to a base of the bipolar transistor, wherein a power supply is connected to the first node and a constant voltage is outputted from a source of the first field-effect transistor.

2. The constant-voltage circuit according to claim 1, wherein the first and second field-effect transistors each have a gate width and a gate length so as to operate with equal current densities.

3. The constant-voltage circuit according to claim 1, wherein the first and second field-effect transistors are depletion-type FETs.

4. The constant-voltage circuit according to claim 1, wherein the bipolar transistor is a heterojunction bipolar transistor.

5. The constant-voltage circuit according to claim 1, wherein the first and second field-effect transistors are pseudomorphic high electron mobility transistors.

6. The constant-voltage circuit according to claim 1, wherein the bias circuit comprises multiple resistors.

7. The constant-voltage circuit according to claim 1, wherein the bias circuit comprises multiple bipolar transistors.

8. The constant-voltage circuit according to claim 1, further comprising a switch element connected to the first node and the power supply.

9. The constant-voltage circuit according to claim 8, wherein the switch element is a third field-effect transistor.

10. The constant-voltage circuit according to claim 9, wherein the third field-effect transistor is a depletion-type FET.

11. The constant-voltage circuit according to claim 9, wherein the third field-effect transistor is a pseudomorphic high electron mobility transistor.

* * * * *